United States Patent [19]

Quartana, III

[11] Patent Number: 4,593,712

[45] Date of Patent: Jun. 10, 1986

[54] PILOT CONTROL VALVE

[76] Inventor: Anthony J. Quartana, III, 111 Derreck Rd., Belle Chasse, La. 70037

[21] Appl. No.: 664,314

[22] Filed: Oct. 24, 1984

[51] Int. Cl.[4] ..... F15B 9/08

[52] U.S. Cl. ..... 137/106; 137/624.14; 137/625.63; 91/308; 91/313

[58] Field of Search ..... 137/106, 624.14, 625.63; 91/304, 313, 308, 350

[56] References Cited

U.S. PATENT DOCUMENTS

| | | | |
|---|---|---|---|
| 151,667 | 6/1874 | Loretz | 137/625.63 |
| 635,537 | 10/1899 | Gasz | 91/304 |
| 923,486 | 6/1909 | Bowen | 91/313 X |
| 2,745,387 | 5/1956 | Dinkelkamp | 91/313 X |
| 3,374,713 | 3/1968 | Broughton | 91/313 X |
| 4,224,013 | 9/1980 | Davis | 91/313 X |

*Primary Examiner*—Alan Cohan

*Attorney, Agent, or Firm*—George A. Bode

[57] ABSTRACT

A pilot control relay valve having first and second elongated valve members coaxially and independently longitudinally shiftable within a valve body between a first position of the first or leading valve member thereby allowing communication of actuating fluid from a supply to a first pressure receiving surface of the second or following valve member to initiate movment of the second valve member from its first position to a second position thereby allowing communication of the actuating fluid to a first pressure receiving surface of a main piston to initiate movement of the first valve member to a second position of the first valve member thereby allowing communication of supply fluid to the second pressure receiving surface of the second valve member thereby initiating movement of the second valve member from its second to its first position thereby allowing communication of supply fluid to a second pressure receiving surface of the main piston to initiate movement of the first valve member to its first position whereby the operation is repeated ad infinitum.

20 Claims, 6 Drawing Figures

PILOT CONTROL VALVE

BACKGROUND OF THE INVENTION

1. Field of the Invention

The present invention relates to pilot control relay valves. Even more particularly, the present invention relates to a pilot control relay valve employed to change the directional flow of fluids to a piston, valve or the like wherein controls provide a fluid signal to drive an end device such as a chemical injection pump to inject chemicals at a slow or rapid rate over a long period of time.

2. General Background of the Invention

Various devices are known which attempt to control a reciprocating pump. Devices of one such type are used in attempting to control a glycol pump which controls the level of liquid in a gas-liquid system and for circulating liquid in a gas-liquid system. These devices require a separate pump and pilot assembly such as that illustrated in U.S. Pat. No. 2,990,910, issued to G. O. Kimmell and entitled "Apparatus And Method For Circulating Controlling Liquids In Gas-Liquid Systems." Problems arise in the use of this type of system in that it simultaneously relieves pressure on the output or "low" side and increases pressure on the input or "high" side thereby preventing the pump from reaching a low speed or pumping rate.

Other pilot control relay valves rely on springs for the backstroke of the actuating piston in the pump which can lead to fatigue and breakdown.

GENERAL DISCUSSION OF THE PRESENT INVENTION

The present invention provides a pilot control relay valve to change the directional flow of fluid to a piston such as the piston of a chemical injection pump for injecting chemicals at a slow or rapid rate over a long period of time.

The pilot control relay valve of the present invention is installed on a piston actuating or stroking an injector pump for injection of a chemical into process lines and includes first and second elongated valve members coaxially and independently longitudinally shiftable within a valve body between a first position of the first or leading valve member thereby allowing communication of actuating fluid from a supply to a first pressure receiving surface of the second or following valve member to initiate movement of the second valve member from its first position to a second position thereby allowing communication of the supply fluid to a first pressure receiving surface of the main piston to initiate movement of the first valve member to a second position of the first or leading valve member thereby allowing communication of supply fluid to the second pressure receiving surface of the second valve member thereby initiating movement of the second or following valve member from its second to its first position thereby allowing communication of the supply fluid to a second pressure receiving surface of the main position to initiate movement of the first valve member to its first position, whereby the operation is repeated again and again.

Movement of the first or "leading" or "piloting" valve member is controlled by the movement of the actuating piston; movement of the second or following valve member is controlled by the selective presence or absence of the supply or control fluid pressure signal acting on different pressure receiving areas of the second valve member which is controlled by the movement of the first valve member; and movement of the actuating piston is controlled by the selective presence or absence of the supply or control fluid pressure signal acting on different pressure receiving surfaces of the actuating piston which is controlled by movement of the second valve member.

The apparatus of the present invention allows for the movement of the first valve member for blocking of all ports and passageways and the bleeding of control fluid from a pressure receiving area of the second valve member before further movement of the first valve member for the "pressuring up" of the opposite pressure receiving area of the second or following valve member to initiate movement of the second or following valve member in the same direction as the first or leading valve member.

It is an object of the apparatus of the present invention to provide a double acting, fast actuating pilot control relay valve powered by a supply fluid and controlled by the same fluid acting as a pilot fluid signal.

It is a further object of the present invention to provide a pilot control relay valve without any springs, nuts, bolts or other components which may fatigue or fail under fluid pressure however, recognizing that fluid under pressure and springs are well known equivalents.

These together with other objects and advantages which will become subsequently apparent reside in the details of construction and operation and is more fully hereinafter described and claimed.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and, wherein:

FIG. 1 is an exploded view of the pilot control relay valve of the apparatus of the present invention with:

FIG. 1A being a perspective view of the valve housing;

FIG. 1B being a perspective view of the second or "following" valve member of the apparatus of the present invention; and FIG. 1C being a perspective view of the first or "leading" valve member of the apparatus of the present invention;

DETAILED DESCRIPTION OF THE PREFERRED EMBODIMENT

Figures 1, 1A, 1B, 1C:
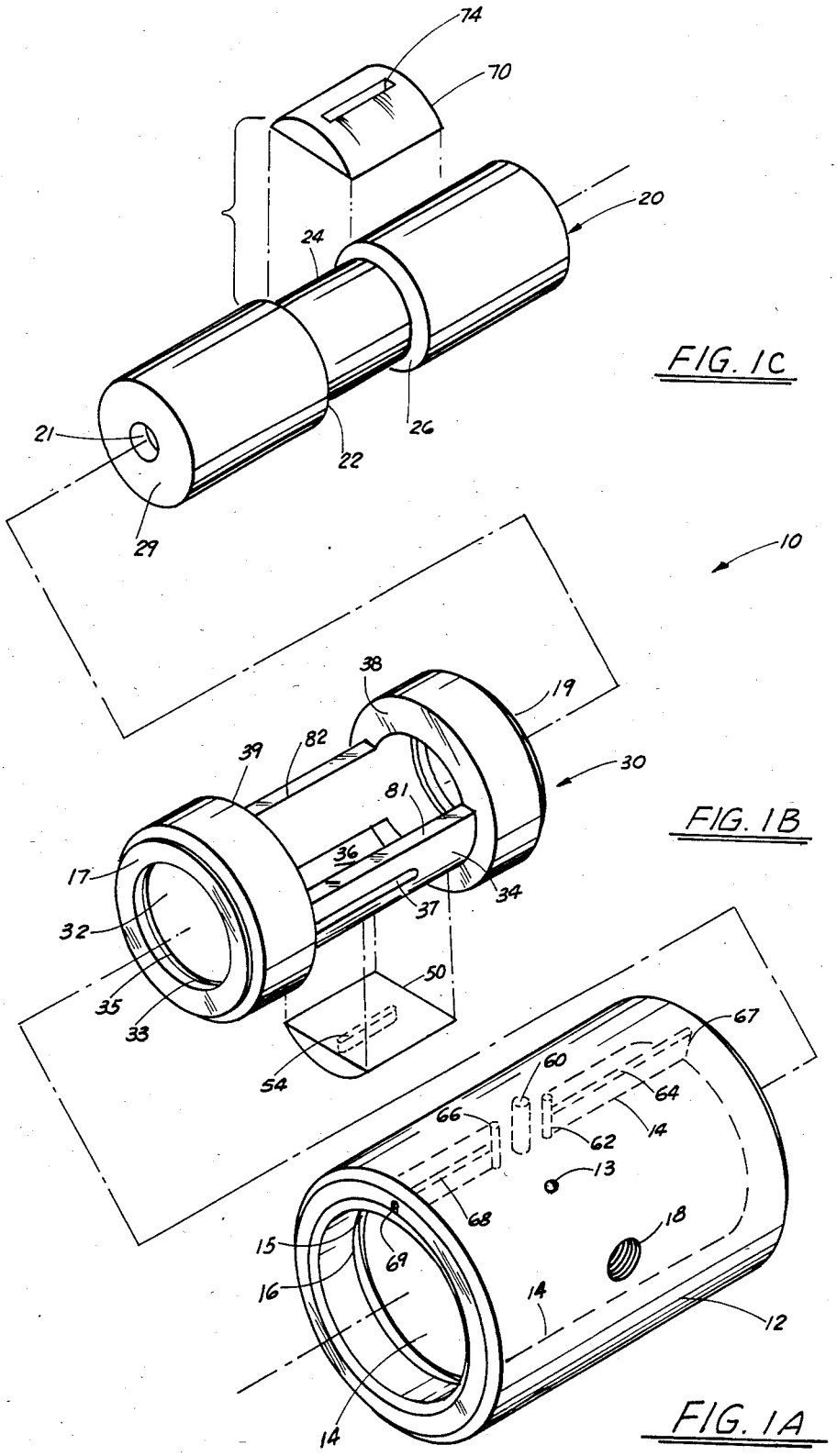

Referring now more specifically to the drawings, reference numeral 10 is used to generally designate the pilot control relay valve comprising the present invention. As will be appreciated from FIGS. 2–4, pilot control relay valve 10, in the contemplated environment, will be positioned to be coupled to the valve stem 112 of a piston 104 utilized particularly in a conventional chemical injection pump 100 to be able to pump at a slow or rapid rate over a long period of time.

Figure 3:
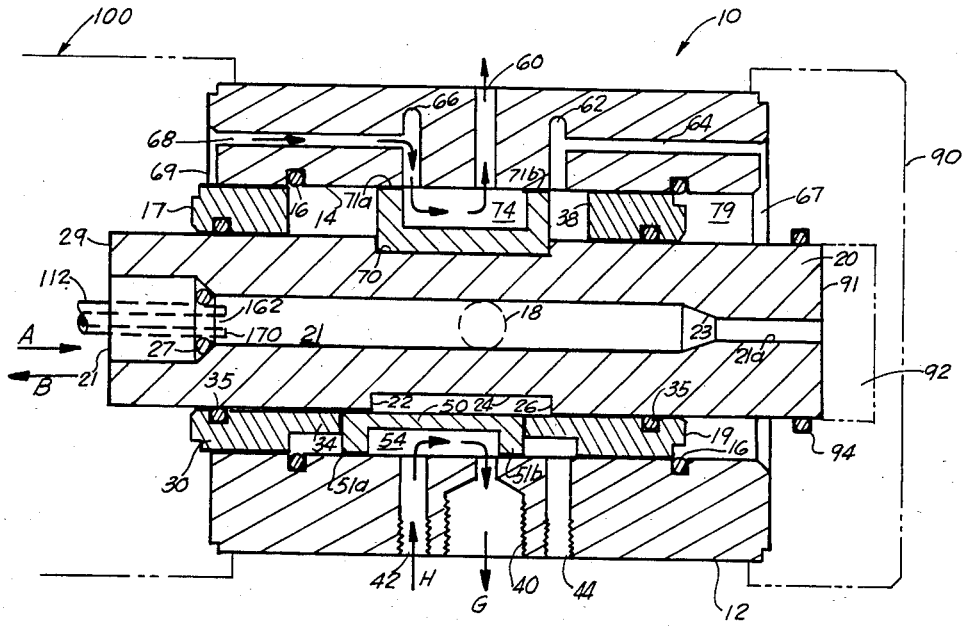
FIG. 3 is a vertical cross-sectional view through the valve of the present invention with the first and second valve members shifted to a position, as in FIG. 2, at the end of their downstroke.
Figure 4:
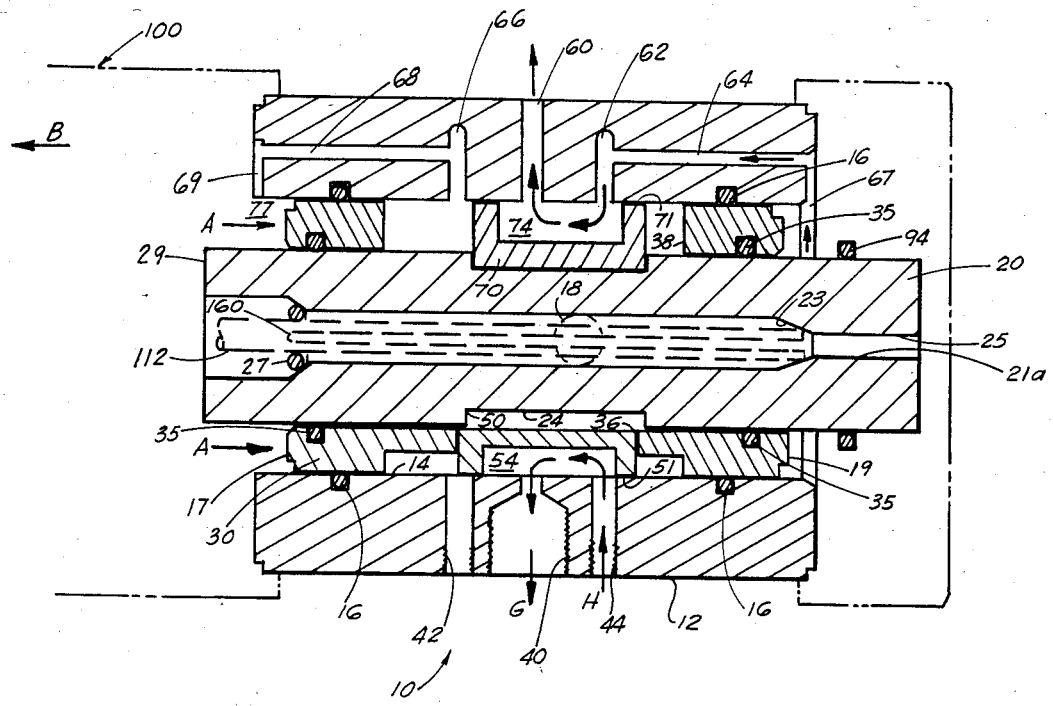
FIG. 4 is a vertical cross-sectional view through the valve of the present invention with the first and second valve members shifted to a position at the end of their upstroke.

Referring now to FIGS. 1, 3 and 4, pilot control relay valve 10 includes an elongated body or valve housing 12 having a central bore 14 therethrough. At each end of valve body 12 there is provided in the interior wall thereof a groove 15 incorporating an O-ring seal 16.

Intermediate the ends of elongated body 12 are provided ports 18, 40, 42, 44 and 60 for providing communication between bore 14 and either a source of supply of control fluid, an end device such as chemical injection pump 100 or the atmosphere for exhaust as described further herein.

There is further provided in valve body 12 proximate to and straddling port 60 a pair of lateral passageways 62, 66 which communicate with bore 14 and longitudinal passageways 64, 68 respectively provided interiorly and longitudinally of valve body 12. There is further provided in valve body 12 proximate its end portions lateral passageways 67, 69 which connect longitudinal passageways 64, 68 respectively with bore 14 near the ends of valve body 12 thus providing, under selected conditions to be discussed further herein, fluid paths 62-64-67 and 66-68-69 from the central portion of bore 14 to its upper and lower end portions respectively.

As best seen in FIGS. 1A and 2–4, in the preferred embodiment, longitudinal passageway 68 and lateral passageways 66 and 69 allow communication of supply or control fluid provided valve body 12 at inlet port 18 from bore 14 to chamber or area 77 of bore 14 under selected conditions; while under other selected conditions allow venting of supply or control fluid from chamber 77 to atmosphere at exhaust port 60; and lateral passageways 62, 67 and longitudinal passageway 64 allow a path for communicating supply fluid provided at inlet port 18 from bore 14 to chamber or area 79 of bore 14 under selected conditions, while under other selected conditions allow a path for venting supply or control fluid from chamber 79 to atmosphere at exhaust port 60. The selected conditions and operational purposes are to be described further herein.

Figure 2:
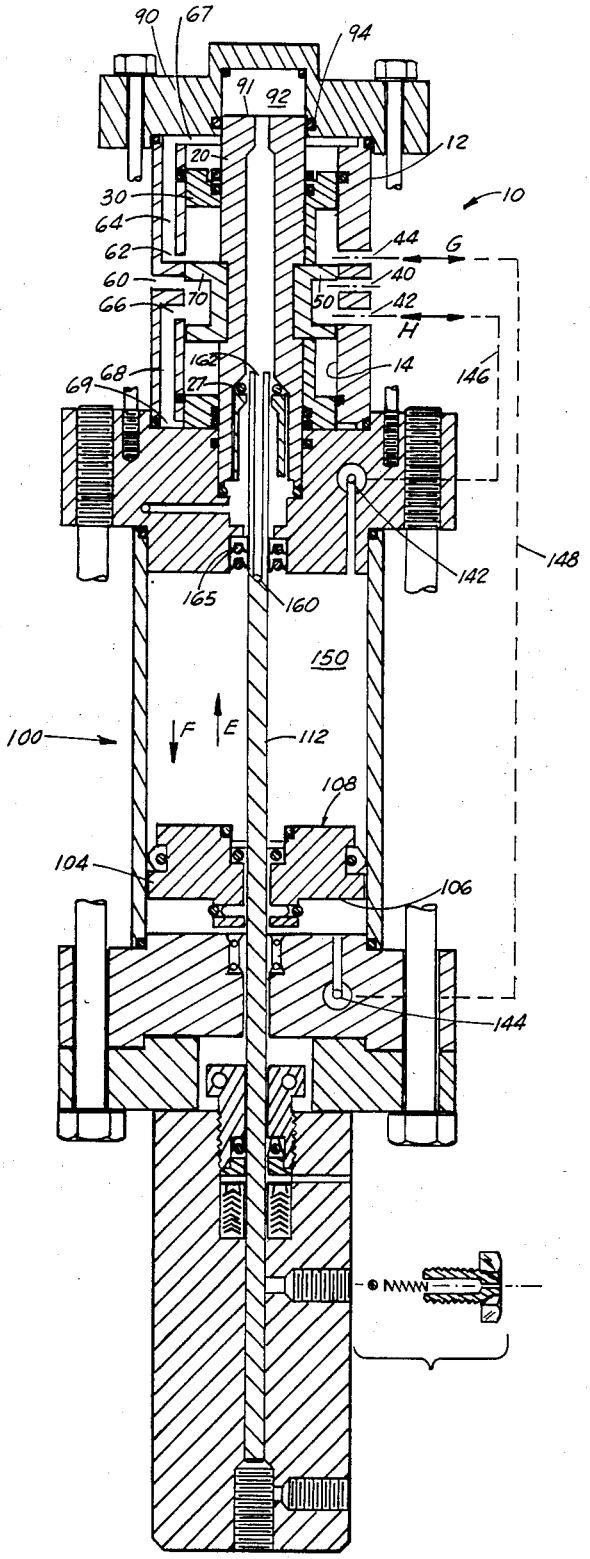
FIG. 2 is a vertical cross-sectional view through the valve of the present invention adapted to a chemical injection pump (for illustrative purposes only) with the first and second valve members shifted to a position at the end of their downstroke (the position of FIG. 3).

As best seen in FIGS. 2–4, valve body 12 is provided with laterally aligned ports 40, 42, and 44 in valve body 12 which are substantially diametrically opposed in valve body 12 to exhaust port 60 and lateral passageways 62, 66. In the preferred embodiment of FIGS. 2–4, ports 42, 44 straddle port 40 and while one selectively communicates with either bore 14 or exhaust port 40 the other selectively communicates with either exhaust port 40 or bore 14 for operational purposes to be described further herein.

Body 12 having central bore 14 therethrough slidably receives first and second valve members 20, 30 in the coaxial manner best illustrated in FIGS. 1, 3 and 4 so that second valve member 30 slidably receives first valve member 20. Second or "following" or "directional" valve member 30 is provided with the central bore 32 and a reduced body portion 34 to define annular shoulder portions 38, 39 thereon. Further, substantially half of the surface area of reduced body portion 34 is removed for purposes to be defined further herein. In the remaining surface area of reduced body portion 34 is provided slot 36 for snugly receiving slide valve member 50. A second narrow longitudinal slot 37 is provided in body portion 34 for providing a means for receiving an alignment screw (not shown) through cavity 13 in valve body 12 which prevents valve members 20 and 30 from rotating relative to valve body 12 but allows longitudinal movement of second valve member 30 within bore 14 for purposes to be described further herein.

Elongated valve body 12 is provided with appropriate O-ring seals 16 in grooves 15 at either end thereof thus precluding the escape of fluid from bore 14 at either end of valve body 12. Second valve member 30 is further provided with an annular groove 33 in the interior of the wall of bore 32 proximate each end thereof. Provided in each of grooves 33 is a sealing O-ring 35 for purposes to be further defined herein. The central bore 32 of second valve member 30 slidably receives first valve member 20.

First or "leading" or "piloting" valve member 20 projects beyond both ends of valve body 12 and second valve member 30 and in normal operation valve body 12 is provided with an end cap 90 sealably connected thereto and valve member 20 is provided with a piston stem 112 partially through its longitudinal bore 21 so that its motion can be controlled by an end item such as a chemical injection pump 100 to be described further herein.

The escape of fluid from bore 14 between first and second valve members 20, 30 at either end of valve body 12 is precluded by appropriate sealing O-rings 35 and between second valve member 30 and bore 14 at either end of valve body 12 by sealing O-rings 16.

First valve member 20 is further provided with reduced body portion 24, best seen in FIGS. 1C, 3 and 4, to define shoulder portions 22, 26. Reduced body portion 24 is provided to snugly accept slide valve member 70 in a manner to be described further herein.

The assembly of apparatus 10 from the exploded view of FIG. 1 to the assembled views of FIGS. 2–4 would require first the sliding engagement of first valve member 20 in the bore 32 of second valve member 30, the orientation of which is irrelevant, and then the mounting of slide valve member 50 in slot 36 in an orientation such that groove 54 of slide valve member 50 will selectively cover ports 40 and 42, or ports 40 and 44 and selectively uncovers ports 44 or 42 in a manner to be described further herein. Then slide valve member 70 is mounted on elongated shoulders members 81, 82 of second valve member 30 such that slide valve member 70 is snugly secured between shoulders 22, 26 of first valve member 20. Then this assembly is slidably received in valve body 12 and rotated to the orientation of FIGS. 2–4 such that edges 71 of slide valve member 70 cover passageways 62, 66 or groove 74 of slide valve member 70 selectively covers exhaust port 60 and lateral passageway 62 or exhaust port 60 and lateral passageway 66 and selectively uncovers lateral passageways 66, 62 in a manner to be described further herein, and groove 54 of slide valve member 50 selectively covers ports 40 and 42 or ports 40 and 44 and selectively uncovers ports 44 or 42 (as described above).

As best seen in FIGS. 3 and 4, exhaust port 60 will always be "covered" by groove 74 of slide valve member 70 with lateral passageways 62, 66 either both being blocked by sealing edges 71 of slide valve member 70 or in the alternative communicating with exhaust port 60 when "covered" by groove 74 of slide valve member 70 or communicating with bore 14 when "uncovered" by groove 74 of slide valve member 70. Similarly exhaust port 40 will always be "covered" by groove 54 of slide valve member 50 with ports 42, 44 either both being blocked by slide valve member 50 or in the alternative communicating with exhaust port 40 when "covered" by groove 54 of slide valve member 50 or communicating with bore 14 when "uncovered" by groove 54 of slide valve member 50. The insertion of an alignment screw (not shown) through cavity 13 provided through body 12 and securing the same in longitudinal slot 37 of second valve member 30 insures the proper alignment of slide valve members 50, 70 and prevents the rotation of valve members 20, 30 relative to valve body 12 yet allows for the independent longitudinal movement of both within bore 14.

It is contemplated in the preferred embodiment that first valve member 20 be manipulated slidably in elongated bore 14 of body 12 and thus in elongated bore 32 of valve member 30 by a double acting pump 100 by means of pressure differentials and the mechanical movement of shaft 112 connected to valve member 20 and that such pump 100 be powered and controlled by pilot fluid provided from the apparatus 10 of the present invention at outlet ports 42, 44 as discussed further herein.

In operation, as pilot control relay valve 10 is in the position of FIG. 3 at the end of its downstroke, second or "following" valve member 30 is at the end of its downward stroke and first valve member 20, also at the end of its downstroke, has begun its upward stroke independently of valve member 30 under the influence of the stem 112 of the end device such as chemical injection pump 100. As best seen in FIG. 2, in the downstroke position of FIG. 3 control pressure provided valve 12 through port 18 communicates through bore 14 and exits port 44 in the direction of ARROW G to line 148 (to be provided inlet 144 to act on lower piston surface 106 of piston 104) and port 42 is vented in the direction of ARROW H through exhaust port 40 as slide valve member 50 at edges 51 sealingly engages the wall of bore 14. Port 44 thus communicates with inlet 144 of pump 100 via line 148 thereby providing supply fluid acting on the lower surface 106 of piston 104 thereby driving it and thus its stem 112 in the direction of ARROW E in FIG. 2 (the direction of ARROW A in FIG. 3). As stem 112 moves upwardly in bore 21 of valve member 20 in the direction of ARROW A (or E) its end portion 170 engages shoulder 23 created by the reduced portion 21*a* of bore 21 of first valve member 20 and mechanically moves first valve member 20 upwardly in the direction of ARROW A (or E) toward the position of FIG. 4 so as to have its upper portion occupy area 92 of end cap 90 sealingly secured to apparatus 10.

As first valve member 20 moves upwardly, or to the right in the direction of ARROW A in FIG. 3, slidably within bore 32 of second valve member 30 and, therefore, bore 14 of valve body 12, slide valve member 70 moves therewith because of the snug fit of slide valve member 70 in first valve member 20 because of the void created by reduced area 24 of first valve member 20 and shoulders 22 and 26 thereof. The movement of first valve member 20 in the direction of ARROW A therefore, also moves groove 74 of slide 70 relative to lateral passageways 62, 66 and port 60. In the position of FIG. 3, any residual pilot control pressure remaining in chamber 77 and acting on lower shoulder or surface area 17 of second valve member 30 is exhausted to atmosphere traveling via passageways 69, 68 and 66 and groove 74 of slide valve member 70 to exhaust port 60. Also, bore 14, in the position of FIG. 3, communicates control pressure via passageways 62, 64 and 67 to area 79 of bore 14 between end cap 90 and upper shoulder or surface area 19 of second valve member 30 to allow supply or control pressure provided through inlet port 18 and into bore 14 to retain second valve member 30 in its downstroke position as illustrated in FIG. 3. Thus by providing passageways 62, 64, 67 as a path for supplying control fluid to act on the surface area or shoulder 19 of valve member 30 and with seals 16 precluding fluid flow between second valve member 30 and the interior wall of valve body 12 and with seals 35 precluding fluid flow between first and second valve members 20, 30, and seals 94 precluding fluid flow between first valve member 20 and chamber or area 92 of end cap 90, second valve member 30 will be maintained in its position of FIG. 3.

Once again, the movement of the right (in the direction of ARROW A of FIG. 3) of first valve member 20 independently of second valve member 30 and mechanically by stem 112 as described above also initiates movement of slide valve member 70 in the direction of ARROW A so as to first "cover" port 60 leaving it open to vent (as it always is) and block passageways 62, 66 by causing both passageways 62, 66 to be blocked by sealing edges 71 of slide valve member 70. Further movement of first valve member 20 to the right causes slide valve member 70 to "cover" passageway 62 with groove 74 and still block passageway 66 with sealing edge 71*a* and thus allow passageway 62 to communicate with exhaust 60. This alignment exhausts supply pressure acting on surface area 19 of second valve member 30 through passageways 67, 64, 62, and groove 74 and finally exhaust port 60. After the pressure acting on surface area 19 of second valve member 30 exhausts through port 60, slide valve member 70 moves still further to the right under the force of valve member 20 (to the position of FIG. 4 although second valve member 30 remains in the position of FIG. 3) and passes or "uncovers" passageway 66 and passageway 66 (which was communicated with exhaust port 60 in the downstroke position of FIG. 3) now admits supply pressure from bore 14 into passageways 66, 68 and 69 to chamber or area 77 to act on surface area or shoulder 17 of second valve member 30. This fluid pressure acting on surface area 17 creates the force which then causes second valve member 30 and, thus slide valve member 50, to be driven, independently of first valve member 20, from the position of FIG. 3 in the direction of ARROW A to the position of FIG. 4 which first valve member 20 has already assumed. This movement of second valve member 30 is sudden and thus "fast actuating" as will be described further herein. Thus it can be seen that first valve member 20 "leads" second valve member 30 from the position of FIG. 3 to the position of FIG. 4.

Upon movement of both valve members 20, 30 to the upstroke position of FIG. 4, slide valve member 50 and thus its groove 54 has suddenly moved relative to ports 42, 40, 44 and "uncovered" port 42 and "covered" ports 40, 44 such that ports 40 and 44 now communicate via groove 54 so that control fluid provided surface area 106 of piston 104 via line 148 is exhausted through ports 44 and 40 and bore 14 now communicates with port 42 to provide control fluid to port 142 via line 146 and therefore to chamber 150 of pump 100. Thus control fluid is now being provided through port 42 to chamber 150 of pump 100 and therefore acting on upper piston surface 108 of piston 104 and control pressure to port 144 previously acting on lower piston surface 106 of pump 100 via port 44 and line 148 is being exhausted through port 40 via groove 54 of slide valve member 50. (The simultaneous blocking of ports 42, 44 by sealing edges 51 of slide valve member 50 occurs during the movement of slide valve member 50 across ports 42, 44, however this is not critical to the operation of apparatus 10 as was the blocking before bleeding by slide valve member 70 relative to port 60 and lateral pasageways 62, 66).

This exhausting of control fluid acting on lower piston surface 106 and providing control fluid acting on upper piston surface 108 now causes movement of piston 104 and therefore stem 112 in the direction of ARROW F in FIG. 2 (ARROW B in FIGS. 3 and 4) to the position of FIGS. 2 and 3. Control fluid provided chamber 150 via port 42, line 146 and port 142 communicates with chamber 92 via inlet 160 and bore 162 of stem 112 thereby causing a greater force acting on upper surface 91 of first valve member 20 than on its lower surface 29 which is sealed off from chamber 50 by sealing O-rings 165 to initiate movement of member 20 in the direction of ARROW B in FIGS. 3 and 4 (ARROW E of FIG. 2).

This downward (toward the position of FIGS. 2 and 3) movement of first valve member 20 in the direction of ARROW F (ARROW B in FIGS. 3 and 4) again moves slide valve member 70 in the direction of ARROW B thereby first covering port 60 and blocking passageways 62 and 66 with sealing edges 71 and then upon further downward movement covering port 60 and passageway 66 thereby communicating passageways 69, 68, 66 and port 60 via groove 74 and uncovering passageway 62 to communicate with bore 14. This first exhausts or "bleeds" pilot control fluid from surface area 17 through passageways 69, 68, 66 and groove 74 to exhaust port 60. Then, the slide valve member 70 when it uncovers passageway 62, admits supply pressure via port 18 through bore 14 and then through passageways 62, 64 and 67 to the area 79 between cap 90 and surface area 19 of second valve member 30 until there is sufficient force on surface area 19 to move (suddenly) second valve member 30 in the direction of ARROW B (independently of first valve member 20 and thus following it) to the position of FIG. 3 in which slide valve member 50 again covers ports 40, 42 and uncovers port 44 allowing port 40 and 42 to communicate thereby exhausting supply control fluid through port 40 from the upper surface area 108 of piston 104 of pump 100 via line 146 and allowing supply fluid to communicate via bore 14 through port 44 and line 148 to act on lower surface area 106 of pump 100.

Apparatus 10 now repeats the strokes from right to left and left to right (of FIGS. 3 and 4) following the above method over and over again.

It is important to note that the movement of slide valve member 70 and thus groove 74 relative to port 60 and passageways 62, 66 is such that the port 60 is always covered and passageways 62, 66 are first blocked by sealing edges 71 of slide valve member 70 and then one is "bled off" before "pressuring up" either surfaces 17, 19 of second valve member 30 through the other passageway to induce movement of second valve member 30 in the direction of slide valve member 70 (following first valve member 20). Allowing control fluid to "bleed off" from one pressure surface before "pressuring up" on the opposite surface of valve member 30 requires that the dimensions of slide valve 70 and groove 74 be precisely determined relative to the diameters and spacing of port 60 and passageways 62, 66. Thus the slide valve member 70 and groove 74 are dimensioned as follows:

groove 74 of slide valve member 70 to cover exhaust port 60 and edges 71 of slide valve member 70 to block passageways 62, 66 and then, upon movement of slide valve 70 in the direction of Arrow A, groove 74 to first cover passageway 62 to exhaust chamber 79 via path 67-64-62-74-60 and thus exhaust fluid pressure acting on surface 19 of second valve member 30 before allowing sealing edge **71*a* to uncover passage 66 so that pilot pressure from bore 14 via passageways 66, 68, 69 acts to "pressure up" surface area 17 of second valve member 30** to induce movement in the direction of ARROW A of FIGS. 3 and 4.

groove 54 of slide valve member 50 to cover port 40 and edges 51 of slide valve member 50 to block ports 42, 44 and then upon movement of slide valve member 50 in the direction of ARROW A, groove 54 to first cover ports 40, 44 to exhaust supply fluid pressure acting on the lower piston surface 106 before allowing sealing edge 51a to uncover port 42 to provide supply fluid pressure from bore 14 through port 42 via line 146 to act on upper piston surface 108 of piston 104 of pump 100 to induce movement of stem 112 and therefore, first valve member 20 in the direction of ARROW B of FIGS. 3 and 4. In this way, chemical injection pumps such as that disclosed in the Kimmell U.S. Pat. No. 2,990,910 Patent discussed above can have its stroking capacity reduced below one stroke per minute, a result which is unobtainable by the present state of the art.

Because many varying and different embodiments may be made within the scope of the inventive concept herein tuaght, and because many modifications may be made in the embodiments herein detailed in accordance with the descriptive requirement of the law, it is to be understood that the details herein are to be interpreted as illustrative and not in a limiting sense.

What is claimed as invention is:

1. A pilot control valve comprising a. a valve body;

b. an elongated bore within said body;

c. a fluid inlet port;

d. first and second fluid outlet ports;

e. a first valve member slidable within said bore;

f. a second valve member unconnected to said first valve member and slidable within said bore and being selectively shiftable between first and second positions, said second valve member presenting first and second pressure surfaces on said valve member selectively exposed to fluid from said fluid inlet port;

said first valve member being selectively shiftable between first and second positions and presenting first and second pressure surfaces on said valve member, said second pressure surface being selectively exposed to fluid from said fluid inlet and said first pressure surface being selectively exposed to means for imparting longitudinal movement of said first valve member from said second to said first position thereof:

said first position of said first valve member allowing communication between said fluid inlet port and said first pressure surface of said second valve member and precluding communication between said fluid inlet port and said second pressure surface of said second valve member, and said second position of said first valve member allowing communication between said fluid inlet port and said second pressure surface of said second valve member and precluding communication between said fluid inlet port and said first pressure surface of said second valve member;

a greater total force on said first pressure surface than on said second pressure surface of said second valve member moving said second valve member to said second position of said second valve member allowing communication between said fluid inlet port and said second fluid outlet port moving said first valve member to its second position, a greater total force on said second pressure surface than on said first pressure surface of said second valve member moving said second valve member to said first position of said second valve member allowing communication between said fluid inlet port and said first fluid outlet port moving said first valve member to said first position.

2. The apparatus of claim 1 further comprising means mounted on said first valve member and slidable therewith for effectively precluding fluid pressure supplied said second valve member from said fluid inlet port from moving said second valve member from said first to said second position and from said second to said first position.

3. The apparatus of claim 2 further comprising means mounted on said second valve member and slidable therewith for effectively precluding fluid pressure supplied said first valve member from said fluid inlet port from moving said first valve member from said first position to said second position and from said second position to said first position.

4. The apparatus of claim 3 further comprising first and second fluid exhaust ports.

5. The apparatus of claim 4 wherein said means for precluding movement of said second valve member from said first position to said second position and said second position to said first position includes:

a third valve member selectively shiftable between a first position allowing fluid communication between said first exhaust port and said second pressure surface of said second valve member and allowing communication between said fluid inlet port and said first pressure surface, and a second position allowing communication between said first exhaust port and said first pressure surface and allowing communication between said fluid inlet port and said second pressure surface.

6. The apparatus of claim 4 wherein said means for precluding movement of said first valve member from said first position to said second position and from said second position to said first position includes:

a fourth valve member selectively shiftable between a first position allowing communication between said second exhaust port and said first fluid outlet port and allowing communication between said fluid inlet port and said second fluid outlet port and a second position allowing communication between said second exhaust port and said second fluid outlet port and allowing communication between said fluid inlet port and said first fluid outlet port.

7. The apparatus of claim 1 wherein said first and second valve members are coaxially aligned slidably within said bore of said valve body.

8. A pilot control valve comprising:

a. a valve body;

b. an elongated bore within said body;

c. a fluid inlet port;

d. first and second fluid outlet ports;

e. first and second fluid exhaust ports;

f. a first valve member slidable within said bore and having an elongated bore therethrough;

g. a second valve member unconnected to said first valve member and slidable within said bore and being selectively shiftable between first and second positions, said second valve member presenting first and second pressure surfaces on said valve member selectively exposed to fluid from said fluid inlet port;

said first valve member being selectively shiftable between first and second positions and presenting first and second pressure surfaces on said valve member, said second pressure surface being selectively exposed to fluid from said fluid inlet through said elongated bore in said first valve member and said first pressure surface selectively exposed to means for imparting longitudinal movement of said first valve member from said second to said first position thereof:

said first position of said first valve member allowing communication between said fluid inlet port and said first pressure surface of said second valve member and precluding communication between said fluid inlet port and said second pressure surface of said second valve member, and said second position of said first valve member allowing communication between said fluid inlet port and said second pressure surface of said second valve member and precluding communication between said fluid inlet port and said first pressure surface of said second valve member;

a greater total force on said first pressure surface than on said second pressure surface of said second valve member moving said second valve member to said second position of said second valve member allowing communication between said fluid inlet port and said second fluid outlet moving said first valve member to its second position, a greater total force on said second pressure surface than on said first pressure surface of said second valve member moving said second valve member to said first position of said second valve member allowing communication between said fluid inlet port and said first fluid outlet port moving said first valve member to said first position.

9. The apparatus of claim 8 further comprising means mounted on said first valve member and slidable therewith for effectively precluding fluid pressure supplied said second valve member from said fluid inlet port from moving said second valve member from said first to said second position and from said second to said first position.

10. The apparatus of claim 9 further comprising means mounted on said second valve member and slidable therewith for effectively precluding fluid pressure supplied said first valve member from said fluid inlet port from moving said first valve member from said first position to said second position and from said second position to said first position.

11. The apparatus of claim 10 further comprising first and second fluid exhaust ports.

12. The apparatus of claim 11 wherein said means for precluding movement of said second valve member from said first position to said second position and said second position to said first position includes:

a third valve member selectively shiftable between a first position allowing fluid communication between said first exhaust port and said second pressure surface of said second valve member and allowing communication between said fluid inlet port and said first pressure surface, and a second position allowing communication between said first exhaust port and said first pressure surface and allowing communication between said fluid inlet port and said second pressure surface.

13. The apparatus of claim 11 wherein said means for precluding movement of said first valve member from said first position to said second position and from said second position to said first position includes:

a fourth valve member selectively shiftable between a first position allowing communication between said second exhaust port and said first fluid outlet port and allowing communication between said fluid inlet port and said second fluid outlet port and a second position allowing communication between said second exhaust port and said second fluid outlet and allowing communication between said fluid inlet port and said first fluid outlet port.

14. The apparatus of claim 8 wherein said first and second valve members are coaxially aligned slidably within said bore of said valve body.

15. A pilot control valve comprising:

a. a valve body;

b. an elongated bore within said body;

c. a fluid inlet port;

d. first and second fluid outlet ports;

e. a first valve member slidable within said bore and having an elongated bore therethrough;

f. a second valve member unconnected to said first valve member and slidable within said bore and being selectively shiftable between first and second positions, said second valve member presenting first and second pressure surfaces on said valve member selectively exposed to fluid from said fluid inlet port;

said first valve member being selectively shiftable between first and second positions and presenting first and second pressure surfaces on said valve member, said second pressure surface being selectively exposed to said fluid from said fluid inlet through said elongated bore in said first valve member and said first pressure surface being selectively exposed to means for imparting longitudinal movement of said first valve member from said second to said first position:

said first position of said first valve member allowing communication between said fluid inlet port and said first pressure surface of said second valve member and precluding communication between said fluid inlet port and said second pressure surface of said second valve member, and said second position of said first valve member allowing communication between said fluid inlet port and said second pressure surface of said second valve member and precluding communication between said fluid inlet port and said first pressure surface of said second valve member;

a greater total force on said first pressure surface than on said second pressure surface of said second valve member moving said second valve member to said second position of said second valve member, a greater total force on said second pressure surface than on said first pressure surface moving said second valve member to said first position;

g. means mounted on said first valve member and slidable therewith for effectively precluding fluid pressure supplied said first and second pressure surfaces of said second valve member from said fluid inlet port from moving said second valve member from said first to said second position and from said second to said first position; and h. means mounted on said second valve member and slidable therewith for effectively precluding fluid pressure supplied said first valve member from said first and second fluid outlet ports from moving said first valve from said first position to said second position and from said second position to said first position.

16. The apparatus of claim 15 further comprising first and second exhaust ports.

17. The apparatus of claim 16 wherein said means for precluding movement of said second valve member from said first position to said second position and said second position to said first position includes:

a third valve member selectively shiftable between a first position allowing fluid communication between said first exhaust port and said second pressure surface of said second valve member, allowing communication between said fluid inlet port and said first pressure surface of said second valve member and precluding communication between said fluid inlet port and said second pressure surface thereby imparting longitudinal movement of said second valve member from said second to said first position of said second valve member, and a second position allowing communication between said first exhaust port and said first pressure surface, allowing communication between said fluid inlet port and said second pressure surface of said second valve member and precluding communication between said fluid inlet port and said first pressure surface, said third valve member during its movement between said first and second positions allowing communication between said first exhaust port and either of said pressure surfaces of said second valve member before allowing communication between said fluid inlet and port and the other of said pressure surfaces of said second valve member.

18. The apparatus of claim 17 wherein said means for precluding movement of said first valve member from said first to said second position and from said second position to said first position includes:

a fourth valve member selectively shiftable between a first position allowing communication between said second exhaust port and said first fluid outlet port, allowing communication between said fluid inlet port and said second fluid outlet port and precluding communication between said second exhaust port and said second fluid outlet port, and a second position allowing communication between said second exhaust port and said second fluid outlet, allowing communication between said fluid inlet port and said first fluid outlet port and precluding communication between said second exhaust port and said first fluid outlet port said fourth valve member during its movement between said first and second positions allowing communication between said second exhaust and and either of said fluid outlet ports before allowing communication between said fluid inlet port and the other of said fluid outlet ports.

19. The apparatus of claim 15 wherein said first and second valve members are coaxially aligned slidably within said bore of said valve body.

20. The apparatus of claim 19 wherein said first and second valve members are longitudinally slidable within said bore, said first valve member's logitudinal movement from its second to its first position inducing movement of said second valve member from its first position to its second position; and said first valve's movement from its first position to its second position inducing movement of said second valve member from its second position to its first position.

* * * * *